United States Patent [19]

Perry

[11] Patent Number: 4,460,174

[45] Date of Patent: Jul. 17, 1984

[54] SELF DEFENSE WEAPON

[76] Inventor: Vince A. Perry, 269 Main St., Massena, N.Y. 13662

[21] Appl. No.: 525,159

[22] Filed: Aug. 22, 1983

[51] Int. Cl.[3] ..... F41B 15/00; A47G 29/10

[52] U.S. Cl. ..... 273/84 R; 70/456 R

[58] Field of Search ..... 273/84 R, 84 A; 70/456 R, 457; 150/40

[56] References Cited

U.S. PATENT DOCUMENTS

| | | | |
|---|---|---|---|
| 1,102,379 | 7/1914 | Zoller | 70/456 R |
| 1,909,932 | 5/1933 | Digel | 273/84 R |
| 2,737,046 | 3/1956 | Jancsics | 70/457 |
| 3,119,429 | 1/1964 | Stiller et al. | 150/40 |
| 3,137,157 | 6/1964 | Ralton | 70/456 R |
| 3,922,895 | 12/1975 | Greenebaum | 70/457 |
| 3,968,669 | 7/1976 | Coleman | 70/456 R |
| 4,007,931 | 2/1977 | Wich et al. | 273/84 R |
| 4,132,408 | 1/1979 | Sabat | 273/84 R |
| 4,155,551 | 5/1979 | Smith | 273/84 R |
| 4,160,369 | 7/1979 | Pearson | 70/456 R |
| 4,298,999 | 11/1981 | Mackey | 70/456 R X |

*Primary Examiner*—William H. Grieb
*Attorney, Agent, or Firm*—Bruns & Wall

[57] ABSTRACT

A hand weapon that appears to be in innocuous key carrying device. The device includes a hollow handle member having a removable end cap to which a number of keys are connected through an axially movable plunger that passes through the cap into the interior of the handle. The inner end of the plunger is secured to one end of a relatively long cord normally stored in the handle, and the other end of the cord is secured to the handle itself. Coacting means are provided on the plunger and handle for releasably holding the end cap in position on the handle but the user can release the end cap which permits the keys to be hurled at an attacker.

8 Claims, 4 Drawing Figures

SELF DEFENSE WEAPON

BACKGROUND OF THE INVENTION

This invention relates generally to hand weapons, and has particular reference to a novel self defense weapon that can be carried in a purse or pocket and has the appearance of a harmless key carrying device.

Heretofore, a number of hand weapons have been developed, primarily for self defense, that are not firearms or knives or dispensers of chemicals. Many of these non-firearm/knife weapons have their origin in the Far East and utilize chains or telescoping sticks or rods. One such instrument that employs a chain is a manriki-gusari while an instrument that utilizes telescoping members is a nunchaku. The well known night and riot sticks carried by law enforcement officers also fall within this category of weapons.

For the average individual who wants only to be able to defend himself, the weapons mentioned above have disadvantages. A stick type weapon, for example, is not easily concealed and since it appears to be a weapon it can provoke a counter-threat and the danger of an escalating confrontation. A chain type weapon such as the manriki-gusari may, on the other hand, be innocent looking but it has the disadvantage of being heavy and cumbersome. Thus, a manriki-gusari typically comprises a relatively heavy eighteen to twenty-four inch chain with a dozen or so brass keys on each end and is not something the average person wishes to carry in a pant's pocket or purse.

Prior art developed in the course of a preliminary search includes U.S. Pat. Nos. 4,132,408 and 4,155,551 both of which disclose nunchaku type weapons. The closest prior art known to the applicant is found in U.S. Pat. Nos. 4,007,931 to H. W. Wich et al and 3,968,669 to B. W. Coleman. The Wich patent is directed to a hand weapon that operates in a manner similar to the present invention. The battery saving key chain disclosed in the Coleman patent is not intended to be used as a weapon but its tubular storage member and extension chain are somewhat similar to the weapon disclosed herein. The applicant's invention differs from the Wich and Coleman devices primarily in that the keys that are hurled at an attacker are attached to the handle through an axially movable, spring biased plunger which is normally held in position on the handle by a releasable keeper element.

Other patents noted in the preliminary search are U.S. Pat. Nos. 2,737,046; 3,922,895; 4,160,369 and 4,298,999.

SUMMARY OF THE INVENTION

The hand weapon of the present invention is not only harmless looking but it is also relatively lightweight and compact. The weapon appears to be an innocuous key carrying device and is essentially comprised of a hollow handle member having a removable end cap to which a number of keys are connected. The keys are connected to the cap through a key ring carried by an axially movable plunger element that passes through the cap into the interior of the handle.

The inner end of the plunger element is secured to one end of a relatively long cord that is normally stored in the handle and the other end of the cord is secured to the handle itself. Coacting means are provided on the plunger and handle for releasably holding the end cap in position on the handle but the user can release the end cap which permits the keys to be hurled at an attacker, the keys being projected outwardly by means of a throwing or slashing motion. The keys can travel outwardly for the full length of the cord which pays out of the handle and since the keys continue to be connected to the handle, more than one blow can be struck at the attacker.

DESCRIPTION OF THE PREFERRED EMBODIMENT

Figure 1:
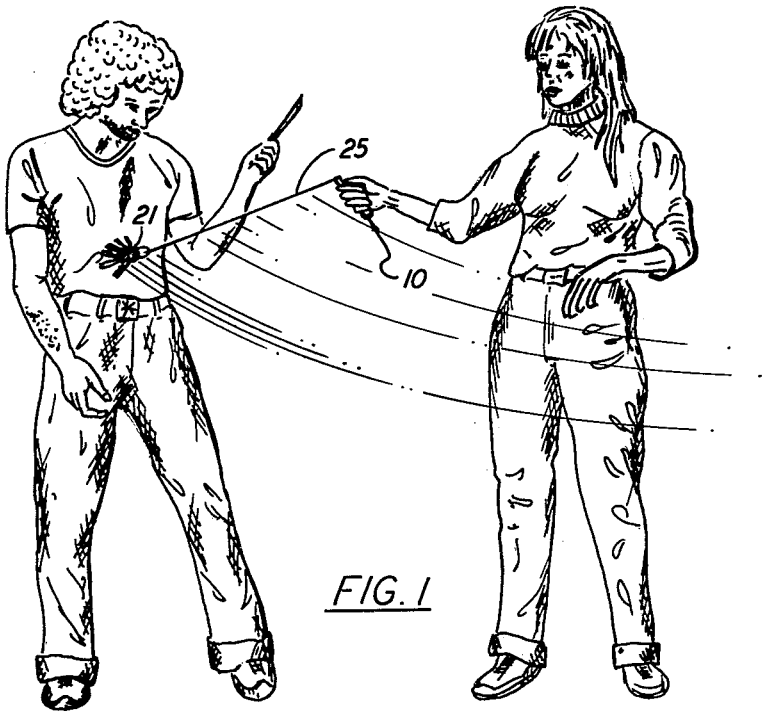
FIG. 1 illustrates a hand weapon embodying the invention as it might be used against an attacker.

Having reference now to the drawings, the hand weapon includes a tubular handle, generally indicated at 10, which comprises a plastic tube 11 having a fixed end cap 12 at one end and a removable end cap 13 at its other end. While the tube 11 is shown as having a smooth surface, it will be understood that it can be provided with a textured or roughened surface, if desired, for better gripping. The removable cap 13 is formed with an aperture 15, FIG. 4, in its end wall and a plunger element 16 passes through this aperture with a sliding fit whereby the plunger is movable axially relative to the end cap and handle. In the illustrated embodiment of the invention, the plunger element 16 is shown as a carriage bolt through which transverse holes 17 and 18 have been drilled adjacent its outer and inner ends respectively.

A key ring 20 passes through the outer plunger element hole 17 and this ring will preferably carry five or more metal keys 21 as shown. A compression spring 22 is mounted on the plunger element between end cap 13 and the key ring 20, the spring when compressed biasing the plunger outwardly. A nut 24, FIG. 4, is threaded on the inner end of the plunger element 16 and serves as a flange on the inner end for a purpose to be described.

The hollow handle 10 provides a storage space for an elongated, flexible cord 25 one end of which is secured by means of a snap swivel 26 to the inner plunger element hole 18. The other end of the cord 25 is secured to the handle by being passed through a hole 27, FIG. 4, in handle tube 11 and then tied to itself. In a preferred embodiment of the invention, the cord 25 is 165 lb. test nylon cord although it will be understood that a suitable length of wire or chain could be substituted. The cord is preferably approximately six times the length of the handle with the latter being approximately four inches long and the cord approximately twenty-four inches long.

Figure 2:
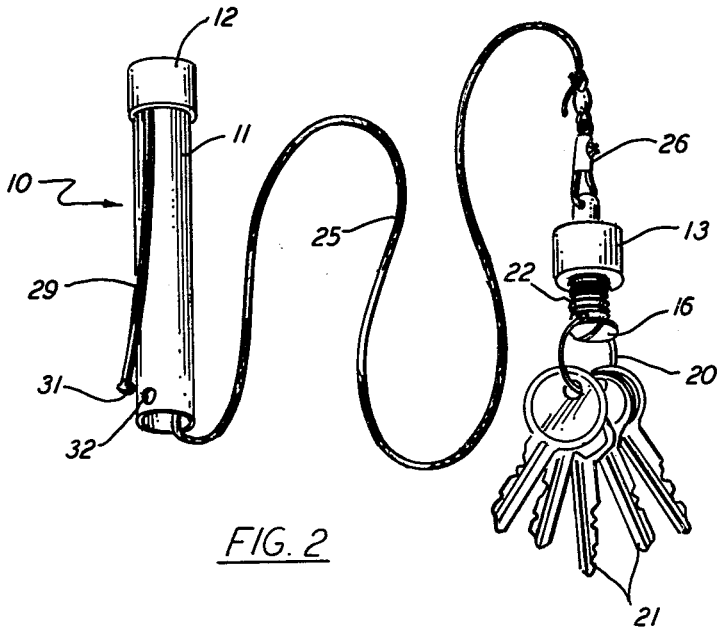
FIG. 2 is a perspective view of the weapon in its open or operating condition.
Figure 3:
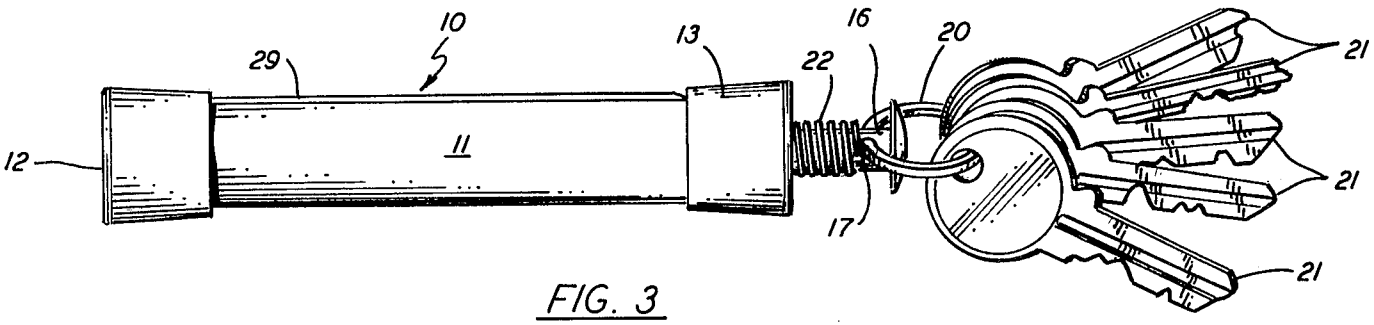
FIG. 3 is an enlarged side elevation of the weapon.
Figure 4:
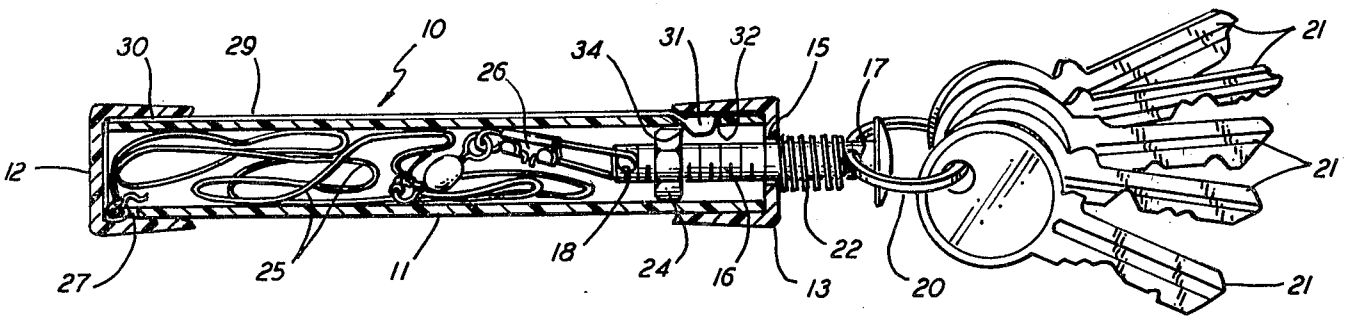
FIG. 4 is a view corresponding with FIG. 3 but with the handle of the weapon being shown in section.

When the hand weapon is in its normal, closed condition, the removable end cap 13 is positioned on the end of the handle tube 11 as shown in FIGS. 3 and 4 and the plunger element is pushed inwardly so that spring 22 is compressed. The plunger is held in this position against the action of the spring by a keeper in the form of a resilient plastic strip 29 secured at one end 30 to the handle and having on its free end a protuberance 31. The protuberance projects through a hole 32, FIGS. 2 and 4, in the handle and overlies the plunger element flange 24. The keeper protuberance is normally held in the hole 32 by the overlying end cap, FIG. 4, but when the cap is removed from the handle the free end of the keeper springs outwardly away from the handle as shown in FIG. 2.

In normal condition, FIG. 4, the end cap 13 holds the keeper protuberance 31 in overlying relation to the plunger flange 24, and the flange in turn is urged into engagement with the protuberance by compression spring 22. The spring fulfills two functions because in addition to biasing the plunger element outwardly and thus biasing its flange 24 into engagement with the keeper protuberance, the equal and opposite force exerted by the spring operates to hold the end cap 13 in position on the handle, overlying the protuberance.

If it becomes necessary to use the hand weapon, the user will grasp the handle and with his thumb, or thumb and forefinger, push the end cap 13 outwardly, further compressing spring 22, until the inner edge of the cap clears the keeper protuberance. As soon as the cap clears the protuberance, the keeper will spring outwardly as shown in FIG. 2 thus releasing the end cap and plunger from the remainder of the handle. Even if the keeper does not spring outwardly on its own, the plunger flange 24 will push the protuberance out of the way by the engagement of the flange with the inclined surface 34, FIG. 4, on the protuberance, the plunger being moved to the right as viewed in FIG. 4 by the action of spring 22.

As soon as end cap 13 and the plunger element are released from the remainder of the handle, the keys 21 can be propelled towards an attacker with a throwing or slashing motion as indicated in FIG. 1. The keys can travel outwardly for the full length of cord 25 which pays out of the handle and since the keys continue to be connected to the handle more than one blow can be struck at the attacker. In addition to having the ability to inflict serious injury to an attacker, particularly in the head area, the weapon has the advantage of surprise due to its innocuous appearance. In the hands of one skilled in the martial arts, the weapon can also be used to entrap or choke at close quarters.

It should also be noted that in the hands of one skilled in the martial arts, the weapon can be used in its normal, closed position for striking, gouging, nerve pinch and pain compliance holds making it an effective device for close range defense.

From the foregoing description, it will be apparent that the invention provides a novel self defense weapon having a number of advantages over prior art weapons of the same type. As will be understood by those familiar with the art, the invention may be embodied in other specific forms without departing from the spirit or essential characteristics thereof.

I claim:

1. A self defense weapon comprising a hollow handle member, an end cap removably mounted on one end of the handle member, plunger means extending through the cap, a ring for receiving keys connected to the plunger means outside the end cap, an elongated flexible element of substantially greater length than the handle member normally stored in the interior of the member, one end of the flexible element being secured to the handle member and the other end thereof being secured to the plunger means inside the end cap, and coacting means on the handle member and plunger means for releasably holding the end cap in position on the handle member, the end cap being movable axially to remove it from the handle member whereby the plunger means and keys on the ring can be hurled at an attacker, the plunger means and keys travelling outwardly to the extent permitted by the full length of the flexible element which is withdrawn from the handle member by the attached plunger means.

2. A weapon as defined in claim 1 wherein the elongated flexible element is a length of nylon cord.

3. A weapon as defined by claim 1 wherein the plunger means comprises an elongated rod element that is movable axially relative to the end cap between inner and outer limiting positions, and spring means on the rod element for biasing it outwardly towards its outer limiting position.

4. A weapon as defined by claim 3 wherein the coacting means for releasably holding the end cap in position comprises flange means adjacent the inner end of the rod element and a keeper on the handle member that releasably engages said flange means, the keeper normally being held in engagement with the flange means by the end cap, the cap being movable axially to permit disengagement of the keeper from the flange means.

5. A weapon as defined by claim 4 wherein the spring means also operates to releasably hold the rod element flange and handle keeper in engagement with one another.

6. A self defense weapon comprising a tubular handle member, a first end cap fixed on one end of the handle member, a second end cap removably mounted on the other end of the handle member, a plunger element extending through the second end cap and being movable axially relative thereto, a ring for receiving a plurality of keys, the ring being connected to the plunger element adjacent its outer end outside the second end cap, a compression spring mounted on the plunger element between the second end cap and key ring, flange means adjacent the inner end of the plunger element inside the second end cap, an elongated flexible element of substantially greater length than the handle member normally stored in the interior of the member, one end of the flexible element being secured to the handle member and the other end thereof being secured to the inner end of the plunger element, and keeper means on the handle member that coacts with the plunger flange means to releasably hold the second end cap in position on the handle member, the second end cap being movable axially to remove it from the handle member whereby the plunger element and keys on the ring can be hurled at an attacker, the plunger element and keys travelling outwardly to the extent permitted by the full length of the flexible element.

7. A weapon as defined in claim 6 wherein the elongated flexible element is a length of nylon cord, the cord length being at least four times the length of the handle member.

8. A weapon as defined in claim 6 wherein the keeper means is a flexible plastic strip secured at one end to the end of the handle member adjacent the first end cap, the strip extending longitudinally along the outside of the handle member to a point adjacent the second cap where the member is formed with a hole in its side wall, the strip having a protuberance at that point which projects through the hole and engages the plunger flange means, the second end cap when mounted on the handle member operating to hold the protuberance in the hole and the compression spring in turn operating to urge the flange means into engagement with the protuberance.

* * * * *